US007867032B2

(12) United States Patent
Trout et al.

(10) Patent No.: US 7,867,032 B2
(45) Date of Patent: Jan. 11, 2011

(54) CONNECTOR ASSEMBLY HAVING SIGNAL AND COAXIAL CONTACTS

(75) Inventors: David Allison Trout, Lancaster, PA (US); James Lee Fedder, Etters, PA (US); Juli S. Olenick, Lake Worth, FL (US); Steven J. Millard, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/250,198

(22) Filed: Oct. 13, 2008

(65) Prior Publication Data

US 2010/0093189 A1 Apr. 15, 2010

(51) Int. Cl.
*H01R 13/648* (2006.01)

(52) U.S. Cl. ..... 439/607.1

(58) Field of Classification Search ..... 439/607.1, 439/607.9, 607.11, 607.7, 607.5, 63, 581, 439/74

See application file for complete search history.

(56) References Cited

U.S. PATENT DOCUMENTS

| | | | | |
|---|---|---|---|---|
| 3,643,201 | A | 2/1972 | Harwood | |
| 4,012,093 | A | 3/1977 | Crane | |
| 4,012,095 | A * | 3/1977 | Doucet et al. | 439/63 |
| 4,085,990 | A | 4/1978 | Jayne | |
| 4,428,632 | A * | 1/1984 | Rich | 439/63 |
| 4,518,210 | A | 5/1985 | Morrison | |
| 4,603,928 | A | 8/1986 | Evans | |
| 4,626,056 | A | 12/1986 | Andrews, Jr. et al. | |
| 4,629,270 | A | 12/1986 | Andrews, Jr. et al. | |
| 4,695,522 | A | 9/1987 | Nalewajek et al. | |
| 4,731,698 | A | 3/1988 | Millot et al. | |
| 4,840,569 | A | 6/1989 | Cabourne | |
| 4,895,521 | A * | 1/1990 | Grabbe | 439/63 |
| 4,895,522 | A * | 1/1990 | Grabbe et al. | 439/63 |
| 5,092,781 | A | 3/1992 | Casciotti et al. | |
| 5,102,342 | A | 4/1992 | Marian | |
| 5,171,154 | A | 12/1992 | Casciotti et al. | |
| 5,228,863 | A | 7/1993 | Campbell et al. | |
| 5,399,104 | A | 3/1995 | Middlehurst et al. | |
| 5,441,424 | A * | 8/1995 | Morlion et al. | 439/581 |
| 5,527,189 | A | 6/1996 | Middlehurst et al. | |
| 5,554,038 | A * | 9/1996 | Morlion et al. | 439/108 |
| 5,567,166 | A | 10/1996 | Lemke | |
| 5,772,451 | A | 6/1998 | Dozier, II et al. | |
| RE36,065 | E * | 1/1999 | Andrews et al. | 439/608 |
| 5,904,581 | A | 5/1999 | Pope et al. | |

(Continued)

FOREIGN PATENT DOCUMENTS

| | | |
|---|---|---|
| EP | 0459356 | 8/1995 |

OTHER PUBLICATIONS

European Search Report, European Application No. EP 09 17 2817, European Filing Date Oct. 12, 2009.

*Primary Examiner*—T C Patel
*Assistant Examiner*—Vladimir Imas

(57) ABSTRACT

A connector assembly includes a housing and contacts. The housing is configured to mate with a mating connector. The contacts are in the housing and configured to electrically connect the connector assembly with the mating connector. The contacts are arranged in a coaxial signal contact pattern. The coaxial signal contact pattern includes a center signal contact surrounded by contacts electrically connected to an electrical ground in a manner to emulate a coaxial connection with the mating connector.

20 Claims, 6 Drawing Sheets

U.S. PATENT DOCUMENTS 6,027,345 A 2/2000 McHugh et al.
6,062,872 A 5/2000 Strange et al.
6,077,090 A 6/2000 Campbell et al.
6,083,047 A 7/2000 Paagman
6,116,965 A 9/2000 Arnett et al.
6,135,781 A 10/2000 Pope et al.
6,179,663 B1 1/2001 Bradley et al.
6,231,391 B1 5/2001 Ramey et al.
6,267,625 B1 7/2001 Gugliotti et al.
6,310,286 B1 10/2001 Troxel et al.
6,394,822 B1 5/2002 McNamara
6,411,517 B1 6/2002 Babin
6,443,745 B1 9/2002 Ellis et al.
6,461,202 B2 10/2002 Kline
6,537,087 B2 * 3/2003 McNamara et al. ..... 439/108
6,551,140 B2 4/2003 Billman et al.
6,623,280 B2 9/2003 Oldenburg et al.
6,682,368 B2 1/2004 Murr et al.
6,695,646 B1 2/2004 Grabbe
6,699,048 B2 3/2004 Johnson et al.
6,705,895 B2 3/2004 Hasircoglu
6,712,620 B1 3/2004 Li et al.
6,739,910 B1 5/2004 Wu
6,743,049 B2 6/2004 Perugini et al.
6,743,057 B2 6/2004 Davis et al.
6,809,255 B1 10/2004 Chun
6,866,521 B1 3/2005 Harper, Jr.
6,872,085 B1 3/2005 Cohen et al.
6,875,056 B1 4/2005 Bianchini et al.
6,899,550 B2 * 5/2005 Perugini et al. ..... 439/74
6,902,416 B2 6/2005 Feldman
6,917,525 B2 * 7/2005 Mok et al. ..... 361/767
6,918,776 B2 7/2005 Spink
6,932,618 B1 8/2005 Nelson
6,932,655 B2 8/2005 Hatterscheid et al.
6,945,788 B2 9/2005 Trout et al.
6,951,482 B1 * 10/2005 Miller et al. ..... 439/581
6,960,103 B2 11/2005 Tokunaga
7,018,239 B2 3/2006 Zaderej et al.
7,021,945 B2 * 4/2006 Perugini et al. ..... 439/74
7,083,428 B1 8/2006 Mahoney et al.
7,086,872 B2 8/2006 Myer et al.
7,086,913 B2 8/2006 Myer et al.
7,097,465 B1 8/2006 Korsunsky et al.
7,097,470 B2 8/2006 Harper
7,114,961 B2 10/2006 Williams
7,179,095 B1 2/2007 Peng et al.
7,180,318 B1 2/2007 Mahoney et al.
7,207,807 B2 4/2007 Fogg
7,244,125 B2 * 7/2007 Brown et al. ..... 439/66
7,262,672 B2 * 8/2007 Lee et al. ..... 333/33
7,297,015 B1 11/2007 Desrosiers et al.
7,309,239 B2 12/2007 Shuey et al.
7,331,830 B2 2/2008 Minich
7,374,441 B2 5/2008 Rubenstein
7,390,194 B1 6/2008 Crippen et al.
7,419,400 B1 9/2008 Taylor
7,425,134 B1 9/2008 Taylor
7,429,176 B2 9/2008 Johnescu et al.
7,438,582 B2 10/2008 Taylor
7,465,195 B1 12/2008 Kerrigan et al.
7,470,149 B2 * 12/2008 Kazama et al. ..... 439/608
2001/0049207 A1 12/2001 Sakata et al.
2002/0151218 A1 10/2002 Figueroa et al.
2003/0027439 A1 2/2003 Johnescu et al.
2003/0064614 A1 4/2003 Tanaka et al.
2003/0082954 A1 5/2003 Espenshade et al.
2003/0162442 A1 8/2003 Panella
2004/0161954 A1 8/2004 Johnescu et al.
2004/0166704 A1 * 8/2004 Perugini et al. ..... 439/74
2004/0174223 A1 9/2004 Achyut
2005/0032437 A1 2/2005 Johnescu et al.
2005/0208828 A1 9/2005 Miller et al.
2005/0250387 A1 11/2005 Brunker et al.
2005/0277315 A1 12/2005 Mongold et al.
2005/0287850 A1 12/2005 Minich et al.
2006/0019517 A1 * 1/2006 Raistrick et al. ..... 439/108
2006/0035530 A1 2/2006 Shuey et al.
2006/0292898 A1 12/2006 Meredith et al.
2007/0059952 A1 3/2007 Raistrick et al.
2007/0097662 A1 5/2007 Dean
2007/0111560 A1 5/2007 Kazama et al.
2007/0190825 A1 8/2007 Shuey et al.
2007/0197095 A1 * 8/2007 Feldman et al. ..... 439/608
2008/0026608 A1 1/2008 Sano et al.
2008/0032524 A1 2/2008 Lemke et al.
2008/0188098 A1 * 8/2008 Boesch et al. ..... 439/74
2008/0214059 A1 9/2008 Rothermel et al.
2008/0220630 A1 9/2008 Sipe et al.
2008/0227314 A1 9/2008 Taylor
2008/0233806 A1 9/2008 Rothermel et al.

* cited by examiner

CONNECTOR ASSEMBLY HAVING SIGNAL AND COAXIAL CONTACTS

BACKGROUND OF THE INVENTION

The invention relates generally to electrical connectors and, more particularly, to a connector assembly that mechanically and electrically connects substrates.

Known mezzanine connector assemblies mechanically and electrically interconnect a pair of circuit boards. The mezzanine connector assemblies engage each of the circuit boards to mechanically interconnect the circuit boards. The circuit boards are separated from one another by a stack height when interconnected by the mezzanine connector. Signal contacts in the mezzanine connector assemblies mate with the circuit boards and provide an electrical connection between the circuit boards. The signal contacts permit the communication of data or control signals between the circuit boards. The signal contacts, however, do not communicate a radio frequency ("RF") signal that is traditionally communicated using coaxial cables or coaxial connectors. Instead, users of known mezzanine connectors must find a separate coaxial connector that can electrically connect the circuit boards. The separate coaxial connector needs to provide for the same stack height between the circuit boards as does the mezzanine connector assembly in order for the coaxial connector and the mezzanine connector to be used together. Finding the coaxial connector with the same stack height as the mezzanine connector assembly may be a difficult or impossible task for some mezzanine connector assemblies.

Thus, a need exists for an improved assembly for providing a coaxial connection between interconnected circuit boards.

BRIEF DESCRIPTION OF THE INVENTION

In one embodiment, a connector assembly includes a housing and contacts. The housing is configured to mate with a mating connector. The contacts are in the housing and configured to electrically connect the connector assembly with the mating connector. The contacts are arranged in a coaxial signal contact pattern. The coaxial signal contact pattern includes a center signal contact surrounded by contacts electrically connected to an electrical ground in a manner to emulate a coaxial connection with the mating connector.

In another embodiment, a mezzanine connector assembly includes a housing and contacts. The housing is configured to interconnect substrates. The contacts are in the housing and configured to electrically connect the substrates. The contacts are arranged in a coaxial signal contact pattern that includes a center signal contact surrounded by contacts electrically connected to an electrical ground in a manner to emulate a coaxial connection between the substrates.

DETAILED DESCRIPTION OF THE INVENTION

Figure 1:
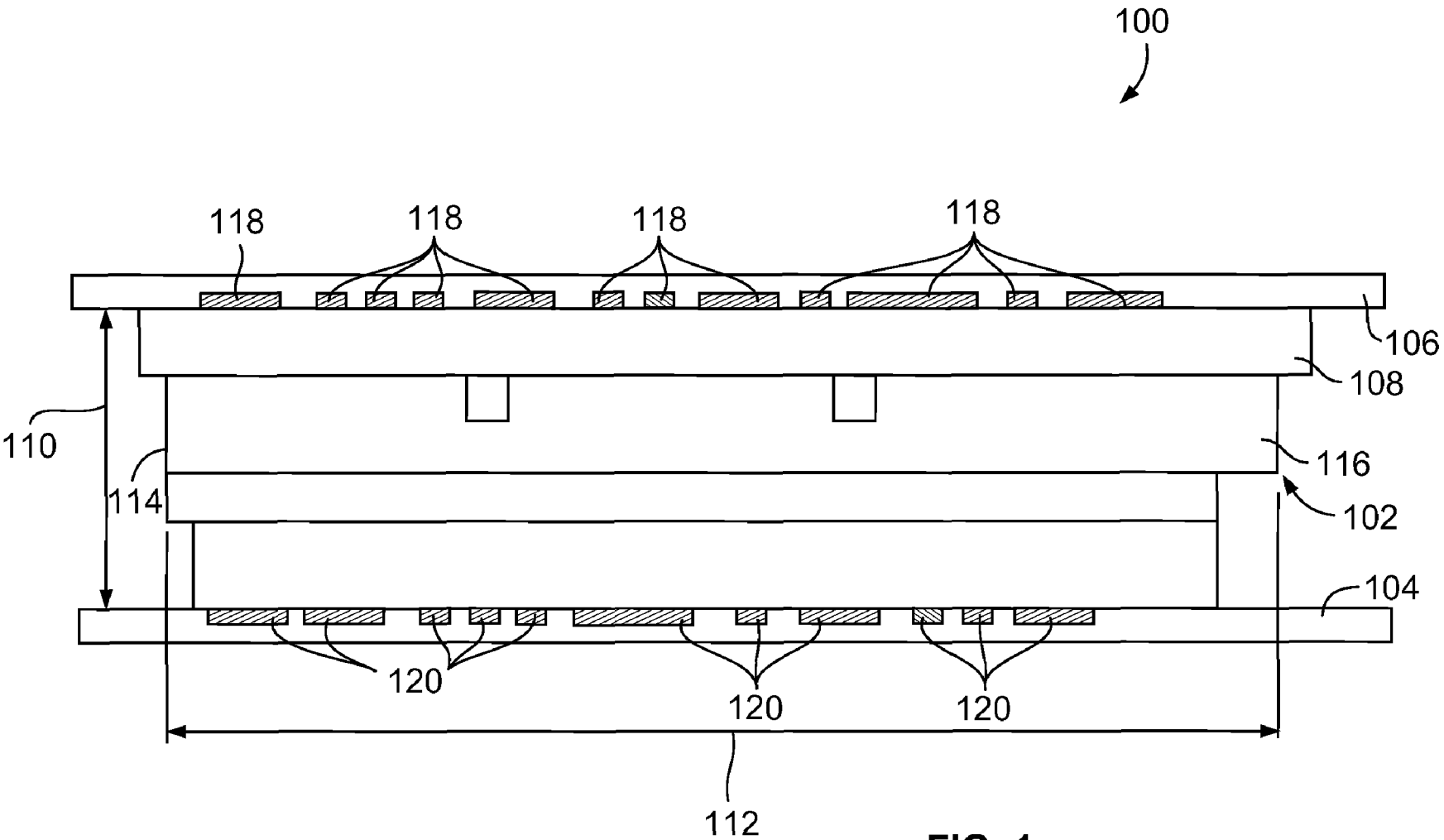
FIG. 1 is an elevational view of a mezzanine connector assembly according to one embodiment.

FIG. 1 is an elevational view of a mezzanine connector assembly 100 according to one embodiment. The connector assembly 100 includes a header assembly 102 and a mating connector 108 that mechanically and electrically connects a plurality of substrates 104, 106 in a parallel arrangement. As shown in FIG. 1, the substrates 104, 106 are interconnected by the connector assembly 100 so that the substrates 104, 106 are substantially parallel to one another. The substrates 104, 106 may include circuit boards. For example, a first, or lower, substrate 104 may be a motherboard and a second, or upper, substrate 106 may be a daughter board. The upper substrate 106 includes conductive pathways 118 and the lower substrate 104 includes conductive pathways 120. The conductive pathways 118, 120 communicate data signals and/or electric power between the substrates 106, 104 and one or more electric components (not shown) that are electrically connected to the substrates 106, 104. The conductive pathways 118, 120 may be embodied in electric traces in a circuit board, although other conductive pathways, contacts, and the like, may be the conductive pathways 118, 120. The terms upper, lower, daughter board and motherboard are used herein to describe the substrates 104, 106 but are not intended to limit the scope of the embodiments described herein. For example, the lower substrate 104 may be disposed above the upper substrate 106 or the substrates 104, 106 may be disposed such that neither is above the other.

The mating connector 108 is mounted to the daughter board 106 in the illustrated embodiment. The header assembly 102 is mounted to the motherboard 104 and mates with the mating connector 108 to electrically and mechanically couple the daughter board 106 and the motherboard 104. In another example, the mating connector 108 is mounted to the motherboard 104. Alternatively, the header assembly 102 may directly mount to each of the daughter board 106 and the motherboard 104 to electrically and mechanically couple the daughter board 106 and the motherboard 104. The daughter board 106 and the motherboard 104 may include electrical components (not shown) to enable the connector assembly 100 to perform certain functions. For purposes of illustration only, the connector assembly 100 may be a blade for use in a blade server. It is to be understood, however, that other applications of the inventive concepts herein are also contemplated.

The header assembly 102 separates the daughter board 106 and the motherboard 104 by a stack height 110. The stack height 110 may be approximately constant over an outer length 112 of the header assembly 102. The outer length 112 extends between opposite outer ends 114, 116 of the header assembly 102. Alternatively, the stack height 110 may differ or change along the outer length 112 of the header assembly 102. For example, the header assembly 102 may be shaped such that the daughter board 106 and the motherboard 104 are disposed transverse to one another. The stack height 110 may be varied by connecting the daughter board 106 and the motherboard 104 using different header assemblies 102 and/or mating connectors 108. The sizes of the header assembly 102 and/or the mating connector 108 may vary so that the stack height 110 may be selected by an operator. For example, an operator may select one header assembly 102 and/or mating connector 108 to separate the daughter board 106 and the motherboard 104 by a desired stack height 110.

Figure 2:
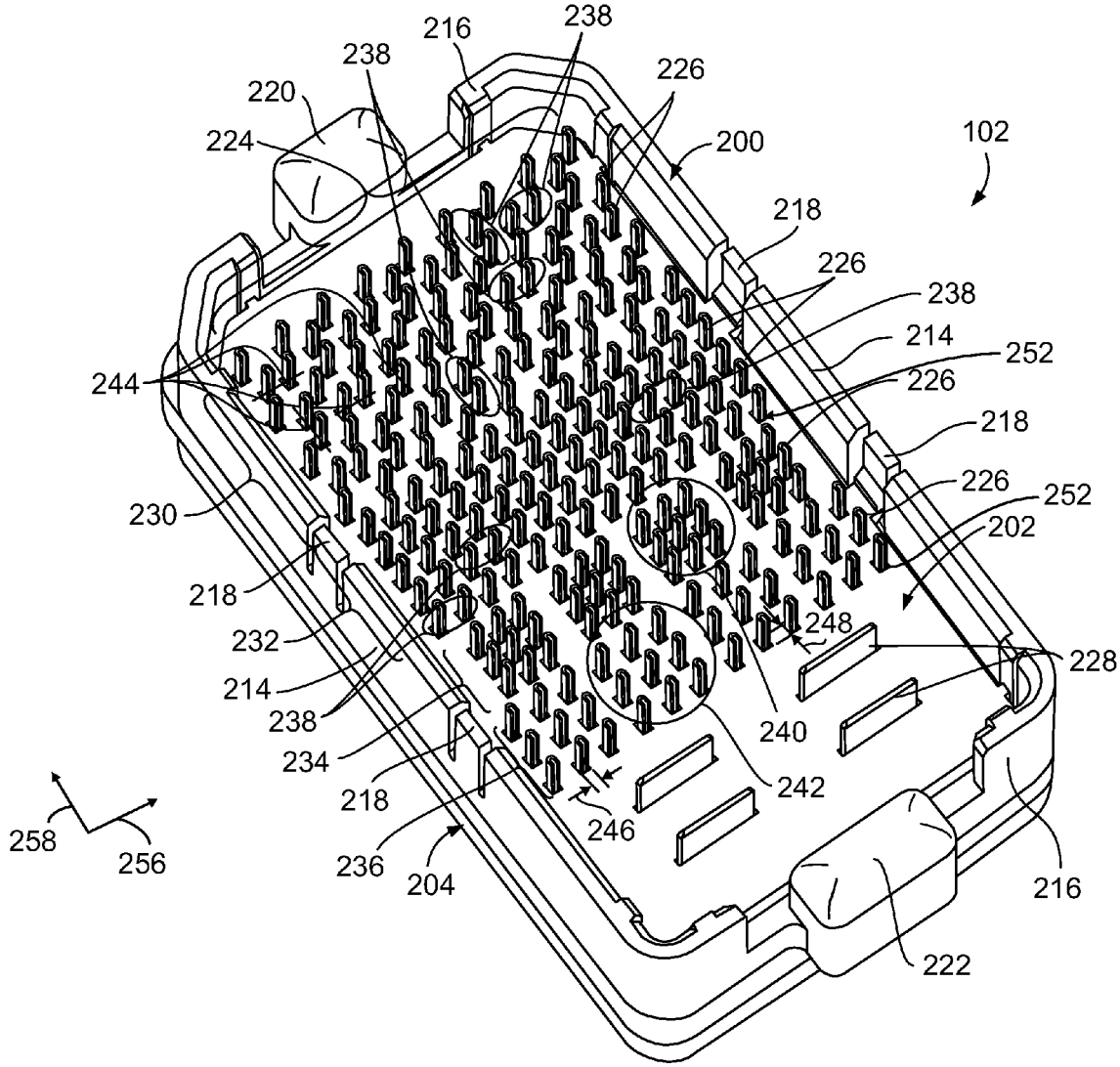
FIG. 2 is a perspective view of a header assembly shown in FIG. 1.

FIG. 2 is a perspective view of the header assembly 102. The header assembly 102 includes a housing 200 that extends between a mating face 250 and a mounting interface 204. The housing 200 may be a unitary body. For example, the housing 200 may be homogeneously formed as a unitary body. The housing 200 may be formed from, or include, a dielectric material. The header assembly 102 includes a contact organizer 202 that is held proximate to the mating face 250 of the header assembly 102. The contact organizer 202 may be homogeneously formed as a unitary body. The contact organizer 202 may be formed from, or include, a dielectric material. The contact organizer 202 is at least partially bounded by plurality of sidewalls 214 and a plurality of end walls 216.

The sidewalls and end walls 214, 216 protrude from the contact organizer 202 in a direction transverse to an upper surface 254 of the contact organizer 202. The sidewalls 214 and end walls 216 form a shroud in which at least a portion of the mating connector 108 is received when the header assembly 162 and the mating connector 108 mate with one another. The sidewalls 214 include latches 218 in the illustrated embodiment. The latches 218 may retain the contact organizer 202 between the sidewalls 214 and end walls 216 to prevent the contact organizer 202 from being removed from the header assembly 102 through the mating face 250. Alternatively, one or more of the end walls 216 may include one or more latches 218.

The end walls 216 include polarization features 220, 222 in the illustrated embodiment. The polarization features 220, 222 are shown as columnar protrusions that extend outward from the end walls 216. The polarization features 220, 222 are received in corresponding polarization slots 508, 510 (shown in FIG. 5) in the mating connector 108 (shown in FIG. 1) to properly orient the header assembly 102 and the mating connector 108 with respect to one another. For example, one polarization feature 222 may be larger than the other polarization feature 220. Each of the slots 508, 510 in the mating connector 108 is shaped to receive a corresponding one of the polarization features 220, 222. As a result, the polarization features 220, 222 and slots 508, 510 permit the header assembly 102 and the mating connector 108 to mate with one another in one a single orientation so that the header assembly 102 and the mating connector 108 are aligned with respect to one another when mated.

The mounting interface 204 mounts to the motherboard 104 (shown in FIG. 1) to electrically and mechanically connect the header assembly 102 with the motherboard 104. The mating face 250 and contact organizer 202 engage the mating connector 108 (shown in FIG. 1) to electrically and mechanically connect the header assembly 102 and the mating connector 108. Alternatively, the mating face 250 may engage the daughter board 106 to electrically and mechanically connect the daughter board 106 with the motherboard 104 (shown in FIG. 1).

The header assembly 102 includes an array 224 of signal contacts 226 and power contacts 228 that extend through the housing 200 and protrude from the mating face 250 and the mounting interface 204. The signal and power contacts 226, 228 extend from the contact organizer 202 through contact through holes 252 to engage the mating connector 108 and from the mounting interface 204 to engage the motherboard 104 (shown in FIG. 1). The signal and power contacts 226, 228 provide electrical connections between the motherboard 104 and the daughter board 106 (shown in FIG. 1). A different number of signal contacts 226 and/or power contacts 228 that those shown in FIG. 2 may be provided. The signal and power contacts 226, 228 extend through the header assembly 102 transverse to the mating face 250 and the mounting interface 204. For example, the signal and power contacts 226, 228 may extend through the header assembly 102 in a perpendicular direction to the mating face 250 and the mounting interface 204. As described below, the signal and power contacts 226, 228 provide the header assembly 102 with the ability to communicate differential pair signals, RF signals and electric power in a single connector. The signal contacts 226 provide the header assembly 102 with the ability to communicate differential pair signals and RF signal using substantially identical contacts.

The power contacts 228 mate with the mating connector 108 (shown in FIG. 1) and the motherboard 104 (shown in FIG. 1) to communicate electric power between the motherboard 104 and the daughter board 106 (shown in FIG. 1). For example, the power contacts 228 may electrically communicate electric current from the motherboard 104 to the daughter board 106. The current may be drawn by electric components (not shown) electrically connected with the daughter board 106 to power the components. In one embodiment, the power contacts 228 communicate electric power that is not used to communicate data or information between the daughter board 106 and the motherboard 104.

The signal contacts 226 mate with the mating connector 108 (shown in FIG. 1) and the motherboard 104 (shown in FIG. 1) to communicate data signals between the motherboard 104 and the daughter board 106 (shown in FIG. 1) and/or provide an electrical ground connection between the motherboard 104 and the daughter board 106. For example, the signal contacts 226 may electrically communicate information, control signals, data, and the like, between the motherboard 104 and the daughter board 106. In one embodiment, the signal contacts 226 communicate electronic signals that are not used to power any other component (not shown) that is electrically connected to the motherboard 104 or the daughter board 106.

The signal contacts 226 are arranged in several sets 230, 232, 234, 236. The signal contacts 226 in each set 230-236 are separated from one another in the contact organizer 202. For example, the signal contacts 226 in each set 230-236 are not interspersed among one another in the embodiment shown in FIG. 2. The first and second sets 230, 232 of signal contacts 226 are arranged in a differential pair pattern and are capable of communicating differential pair signals. In one embodiment, the signal contacts 226 in the first set 230 communicate differential pair signals at a higher data rate than the signal contacts 226 in the second set 232. The differential pair pattern in the sets 230, 232 includes the signal contacts 226 arranged in pairs 238 of signal contacts 226. Each pair 238 of signal contacts 226 includes a plurality of the signal contacts 226 that communicate a differential pair signal. For example, the pairs 238 of signal contacts 226 in the first and second sets 230, 232 may communicate differential pair signals between the daughter board 106 (shown in FIG. 1) and the motherboard 104 (shown in FIG. 1). The signal contacts 226 in the first set 230 may be arranged in a noise-reducing differential signal contact pair as disclosed in co-pending U.S. patent application Ser. No. 12/250,268, entitled "Connector Assembly Having A Noise-Reducing Contact Pattern," filed Oct. 13, 2008 (referred to as the '268 application). For example, the signal contacts 226 in each pair 238 in the first set 230 may be oriented along a contact pair line 244. The contact pair lines 244 of adjacent contact pairs 238 are transverse with respect to one another. For example, the contact pair lines 244 of adjacent pairs 238 may be perpendicular to one another.

The signal contacts 226 in the second set 232 are arranged in a regularly spaced grid. For example, the signal contacts 226 may be equidistantly spaced from one another in two transverse directions 256, 258 in the plane of the upper surface 254 of the contact organizer 202. The equidistant spacing of the signal contacts 226 may continue throughout the set 232 of contacts 226. Optionally, the spacing between the signal contacts 226 in the second set 232 in one direction 256 may differ from the spacing between the signal contacts 226 in another direction 258. The regularly spaced grid of the signal contacts 226 may permit a variety of uses for the signal contacts 226. For example, some of the signal contacts 226 may be used as ground contacts while other signals contacts 226 are used to communicate data signals. In one embodiment, the signal contacts 226 in the second set 232 are used to communicate signals other than differential pair signals. For example, the signal contacts 226 may communicate data signals other than differential pair signals.

The signal contacts 226 in the third and fourth sets 234, 236 are arranged in groups 240, 242. Each group 240, 242 includes the signal contacts 226 arranged in a coaxial signal contact pattern and is configured to communicate signals in a manner that emulates a coaxial connection. For example, the signal contacts 226 in the coaxial signal contact pattern may emulate a coaxial connector by communicating an RF signal between the motherboard 104 (shown in FIG. 1) and the daughter board 106 (shown in FIG. 1). By way of example only, the groups 240 of signal contacts 226 may emulate a coaxial connector having an impedance of approximately 50 Ohms and the groups 242 of signal contacts 226 may emulate a coaxial connector having an impedance of approximately 75 Ohms. The signal contacts 226 may emulate coaxial connectors having different impedances. As described below with respect to FIGS. 6 and 8, the signal contacts 226 may emulate coaxial connectors with different impedance characteristics by increasing or decreasing the spacing between the signal contacts 226.

In one embodiment, the signal contacts 226 in each of the sets 230-236 are substantially identical with respect to one another. For example, the same type of contact having substantially similar dimensions and including or formed of the same or similar materials may be used as the signal contacts 226 in each of the sets 230-236. The signal contacts 226 may have a common width 246 in a plane that is parallel to the upper surface 254 of the contact organizer 202. The signal contacts 226 may have a common depth dimension 248 in a direction that is transverse to the direction in which the common width 246 is measured and that is in a plane parallel to the upper surface 254 of the contact organizer 202.

Figure 3:
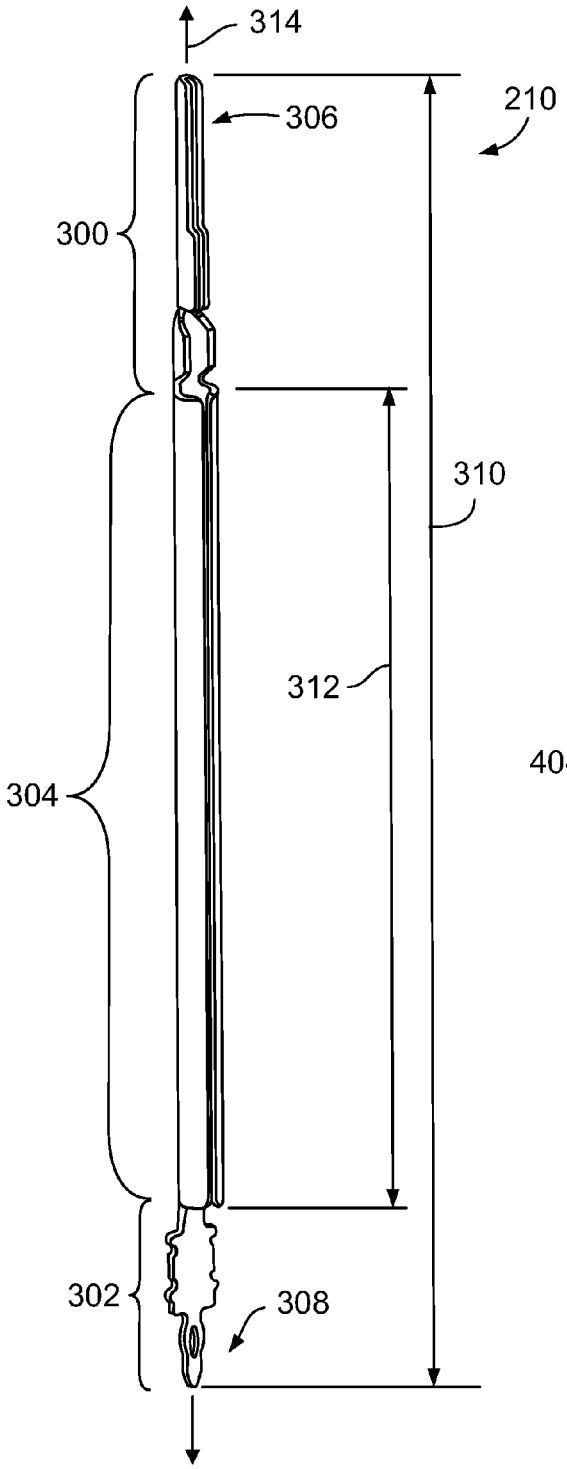
FIG. 3 is a perspective view of a signal contact shown in FIG. 2 according to one embodiment.

FIG. 3 is a perspective view of the signal contact 226 according to one embodiment. The signal contact 226 includes a signal mating end 300 coupled to a signal mounting end 302 by a signal contact body 304. The signal contact 226 has an elongated shape oriented along a longitudinal axis 314. The signal mating and mounting ends 300, 302 extend from the signal contact body 304 in opposite directions along the longitudinal axis 314. The signal contact 226 includes, or is formed from, a conductive material. For example, the signal contact 226 may be stamped and formed from a sheet of metal. Alternatively, the signal contact 226 may be formed from a dielectric material with at least a portion of the signal contact 226 plated with a conductive material.

The signal mating end 300 protrudes from the contact organizer 202 (shown in FIG. 2) of the header assembly 102 (shown in FIG. 1). The signal mating end 300 mates with the mating connector 108 (shown in FIG. 1). Alternatively, the signal mating end 300 mates with the daughter board 106 (shown in FIG. 1). The signal mating end 300 includes a mating pin 306 that is received by a corresponding contact (not shown) in the mating connector 108 or the daughter board 106. In another embodiment, the signal mating end 300 includes a receptacle that receives the corresponding contact in the mating connector 108 or daughter board 106. The signal mating end 300 is electrically connected with at least one of the conductive pathways 118 (shown in FIG. 1) in the daughter board 106 when the signal mating end 300 is mated with the mating connector 108 or the daughter board 106.

The signal mounting end 302 protrudes from the mounting end 204 (shown in FIG. 2) of the header assembly 102 (shown in FIG. 1). The signal mounting end 302 is mounted to the motherboard 104 (shown in FIG. 1). The signal mounting end 302 includes a mounting pin 308 that is loaded into a cavity (not shown) in the motherboard 104. For example, the mounting pin 308 may be received by a plated cavity in the motherboard 104 that is electrically connected to at least one of the conductive pathways 120 in the motherboard 104. The signal mounting end 302 is electrically connected with at least one of the conductive pathways 120 in the motherboard 104 when the signal mounting end 302 is mounted to the motherboard 104. As shown in FIG. 3, the signal contact body 304 has a tubular shape, although other shapes are contemplated within the embodiments described herein. The signal contact body 304 is disposed between the signal mating and mounting ends 300, 302.

An overall length 310 of the signal contact 226 can be varied to adjust the stack height 110 (shown in FIG. 1) between the daughter board 106 (shown in FIG. 1) and the motherboard 104 (shown in FIG. 1). For example, if the overall length 310 of the signal contacts 226 loaded into the header assembly 102 (shown in FIG. 1) is increased, the daughter board 106 and the motherboard 104 may be separated by an increased distance. Alternatively, a length 312 of the signal contact body 304 can be varied to change the overall length 310 of the signal contact 226. Adjusting the overall length 310 and/or the length 312 of the signal contact body 304 provides an operator of the header assembly 102 with the ability to select a desired stack height 110 between the daughter board 106 and the motherboard 104. For example, if an operator wants the daughter board 106 and the motherboard 104 to be separated by a greater stack height 110, then the operator can select signal contacts 226 with a greater overall length 310 and/or length 312 of the signal contact body 304. In another example, if the operator wants the daughter board 106 and the motherboard 104 to be separated by a lesser stack height 110, then the operator can select signal contacts 226 with a lesser overall length 310 and/or length 312 of the signal contact body 304.

Figure 4:
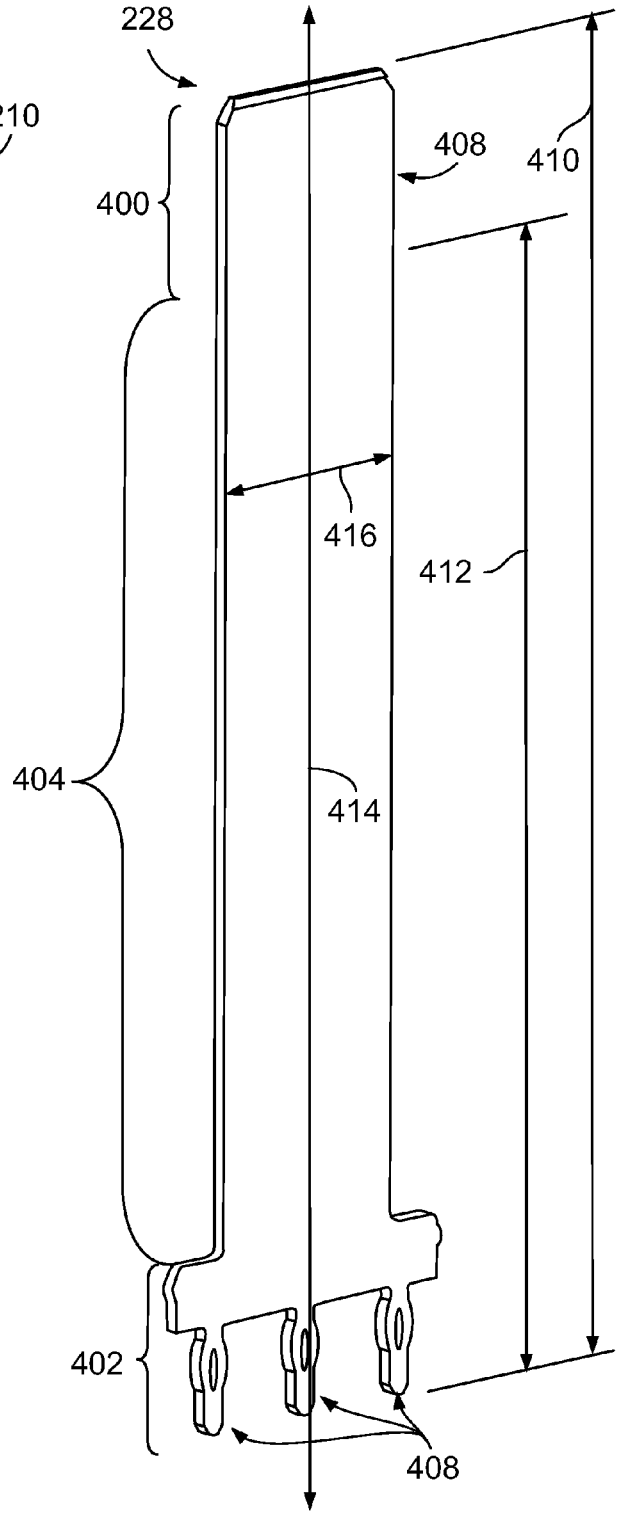
FIG. 4 is a perspective view of a power contact shown in FIG. 2 according to one embodiment.

FIG. 4 is a perspective view of the power contact 228 according to one embodiment. The power contact 228 includes a power mating end 400 coupled to a power mounting end 402 by a power contact body 404. The power contact 228 has an elongated shape oriented along a longitudinal axis 414. The power mating and mounting ends 400, 402 extend from the power contact body 404 in opposite directions along the longitudinal axis 414. The power contact 228 includes, or is formed from, a conductive material. For example, the power contact 228 may be stamped and formed from a sheet of metal.

The power mating end 400 protrudes from the contact organizer 202 (shown in FIG. 2) of the header assembly 102 (shown in FIG. 1). The power mating end 400 mates with the mating connector 108 (shown in FIG. 1). Alternatively, the power mating end 400 mates with the daughter board 106 (shown in FIG. 1). The power mating end 400 includes a mating blade 406 that is received by a corresponding contact (not shown) in the mating connector 108 or the daughter board 106. In another embodiment, the power mating end 400 has a shape other than that of a blade. For example, the power mating end 400 may include a mating pin. The power mating end 400 optionally may include a receptacle that receives the corresponding contact in the mating connector 108 or daughter board 106. The power mating end 400 is electrically connected with at least one of the conductive pathways 118 (shown in FIG. 1) in the daughter board 106 when the power mating end 400 is mated with the mating connector 108 or the daughter board 106.

The power mounting end 402 is mounted to the motherboard 104 (shown in FIG. 1). The power mounting end 402 includes mounting pins 408 that are loaded into cavities (not shown) in the motherboard 104. For example, the mounting pins 408 may be received by a plated cavity in the motherboard 104 that is electrically connected to at least one of the conductive pathways 120 in the motherboard 104. While three mounting pins 408 are shown in FIG. 4, a different number of mounting pins 408 may be provided. The power mounting end 402 is electrically connected with at least one of the conductive pathways 120 in the motherboard 104 when the power mounting end 402 is mounted to the motherboard 104. The power contact body 404 is disposed between the power mating and mounting ends 400, 402.

The power contact body 404 has an outside width 416 in a direction transverse to the longitudinal axis 414. For example, the power contact body 404 has a width 416 in a direction perpendicular to the longitudinal axis 414 such that the power contact body 404 has a planar shape in a plane defined by the longitudinal axis 414 and the width 416 of the power contact body 404. The planar shape of the power contact body 404 may be continued in the power mating end 400 and/or the power mounting end 402 as shown in the illustrated embodiment. Alternatively, the shape of the power contact body 404 may differ from the shape of the power mating end 400 and/or the power mounting end 402. The power contact body 404 may be larger than the signal contact body 304 (shown in FIG. 3) to permit the power contact body 404 to communicate a greater electric current than the signal contact body 304.

An overall length 410 of the power contact 228 can be varied to adjust the stack height 110 (shown in FIG. 1) between the daughter board 106 (shown in FIG. 1) and the motherboard 104 (shown in FIG. 1). For example, if the overall length 410 of the power contacts 228 loaded into the header assembly 102 (shown in FIG. 1) is increased, the daughter board 106 and the motherboard 104 may be separated by an increased distance. Alternatively, a length 412 of the power contact body 404 can be varied to change the overall length 410 of the power contact 228. Adjusting the overall length 410 and/or the length 412 of the power contact body 404 provides an operator of the header assembly 102 with the ability to select a desired stack height 110 between the daughter board 106 and the motherboard 104. For example, if an operator wants the daughter board 106 and the motherboard 104 to be separated by a greater stack height 110, then the operator can select power contacts 228 with a greater overall length 410 and/or length 412 of the power contact body 404. In another example, if the operator wants the daughter board 106 and the motherboard 104 to be separated by a lesser stack height 110, then the operator can select power contacts 228 with a lesser overall length 410 and/or length 412 of the power contact body 404.

Figure 5:
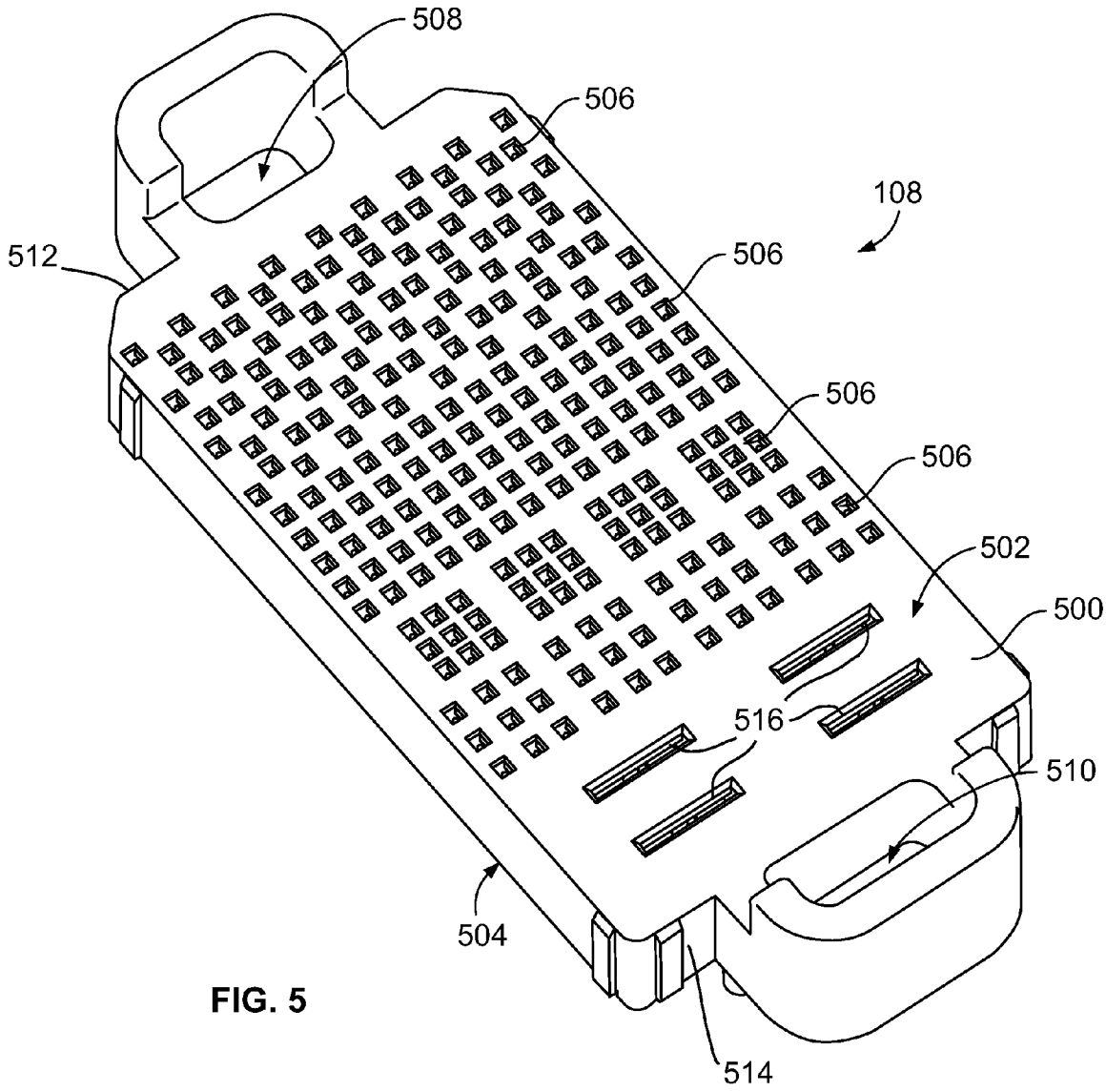
FIG. 5 is a perspective view of a mating connector shown in FIG. 1.

FIG. 5 is a perspective view of the mating connector 108. The mating connector 108 includes a housing 500 that extends between a mating face 502 and a mounting interface 504. The housing 500 may be homogeneously formed as a unitary body. In one embodiment, the housing 500 is formed of, or includes, a dielectric material. The mating interface 502 engages the mating face 250 (shown in FIG. 2) and the contact organizer 202 (shown in FIG. 2) of the header assembly 102 (shown in FIG. 1) when the mating connector 108 and the header assembly 102 mate with one another. The mounting interface 504 engages the daughter board 106 (shown in FIG. 1) when the mating connector 108 is mounted to the daughter board 106. The mating connector 108 includes a plurality of cavities 506 and slots 516 that are configured to receive the signal and power contacts 226, 228 (shown in FIG. 2), respectively. Mating contacts (not shown) may be held in the cavities 506 and slots 516. The mating contacts may electrically connect with the signal and power contacts 226, 228 when the mating connector 108 and the header assembly 102 mate with one another. Alternatively, the mating contacts in the cavities 506 and slots 516 may be received by the signal and power contacts 226, 228 when the mating connector 108 and the header assembly 102 mate with one another.

The polarization slots 508, 510 are disposed proximate to opposite ends 512, 514 of the housing 500. As described above, the polarization slot 508 is shaped to receive the polarization feature 220 (shown in FIG. 2) of the mezzanine connector 102 (shown in FIG. 1) and the polarization slot 510 is shaped to receive the polarization feature 222 (shown in FIG. 2) of the header assembly 102 to align the mating connector 108 and the header assembly 102 with respect to one another. The cavities 506 and slots 516 in the housing 500 are arranged to match up with and receive the signal and power contacts 226, 228 when the polarization features 220, 222 are received by the slots 508, 510.

Figure 6:
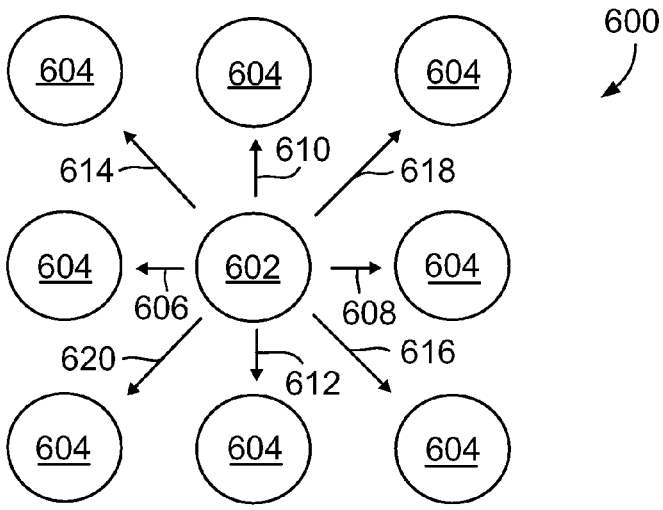
FIG. 6 is a schematic view of an example arrangement of the signal contacts shown in FIG. 2 in one or more groups also shown in FIG. 2.

FIG. 6 is a schematic view of an example arrangement 600 of the signal contacts 226 (shown in FIG. 2) in one or more of the groups 240, 242 (shown in FIG. 2). The arrangement 600 illustrates the locations of signal contacts 226 in one or more of the groups 240, 242 in order for the group 240, 242 to emulate a coaxial connection. The arrangement 600 includes a center location 602 with a plurality of ground locations 604 disposed around the center location 602. One signal contact 226 may be disposed at the center location 602 with a plurality of signal contacts 226 disposed at the ground locations 604 around the periphery of the center location 602. In operation, the signal contact 226 in the center location 602 in the groups 240, 242 communicates a data signal. For example, the signal contact 226 in the center location 602 (referred to as the center signal contact 226) may communicate a signal in a manner that is similar to the center conductor in a coaxial cable connector. The signal contacts 226 disposed in the ground locations 604 are electrically connected to an electric ground. For example, the signal contacts 226 may be electrically connected to an electric ground of the motherboard 104 (shown in FIG. 1). The signal contacts 226 in the ground locations 604 may provide a ground reference and reduce coupled electrical noise for the center signal contact 226. For example, the signal contacts 226 in the ground locations 604 may emulate the shield in a coaxial cable connector. While eight ground locations 604 are shown in the illustrated embodiment, a different number of ground locations 604 may be used. Moreover, while the discussion herein focuses on the signal contacts 226 being disposed at the center location 602 and ground locations 604, the cavities 506 (shown in FIG. 5) in the mating connector 108 (shown in FIG. 1) may be arranged in a manner similar to the signal contacts 226. For example, the cavities 506 may be arranged in the arrangement 600 such that the cavities 506 may mate with the signal contacts 226.

In the illustrated embodiment, the ground locations 604 are arranged in a polygon shape, such as a square or rectangle, around the center location 602. The ground locations 604 may immediately surround the center location 602 such that all locations or contacts that are adjacent to the center location 602 are ground locations 604. For example, ground locations 604 may be disposed in the locations adjacent to the center location 602 in horizontal directions 606, 608 from the center location 602, in transverse directions 610, 612 from the center location 602, and in diagonal directions 614-620 from the center location 602. The signal contacts 226 used to communicate a data signal may only have signal contacts 226 connected to an electrical ground disposed in all adjacent locations to the signal contact 226. No two signal contacts 226 are adjacent to one another in the arrangement 600 shown in FIG. 6.

As described above, the signal contacts 226 in the arrangement 600 may emulate a coaxial connector. The impedance of the coaxial connector that is emulated by the signal contacts 226 may be varied by changing the separation between the signal contacts 226 in the directions 606-620. For example, increasing the separation between the signal contacts 226 in the directions 606-620 may increase the impedance of the coaxial connector that is emulated by the signal contacts 226 in the arrangement 600. Alternatively, reducing the separation between the signal contacts 226 in the directions 606-620 may decrease the impedance of the coaxial connector that is emulated by the signal contacts 226 in the arrangement 600

Figure 7:
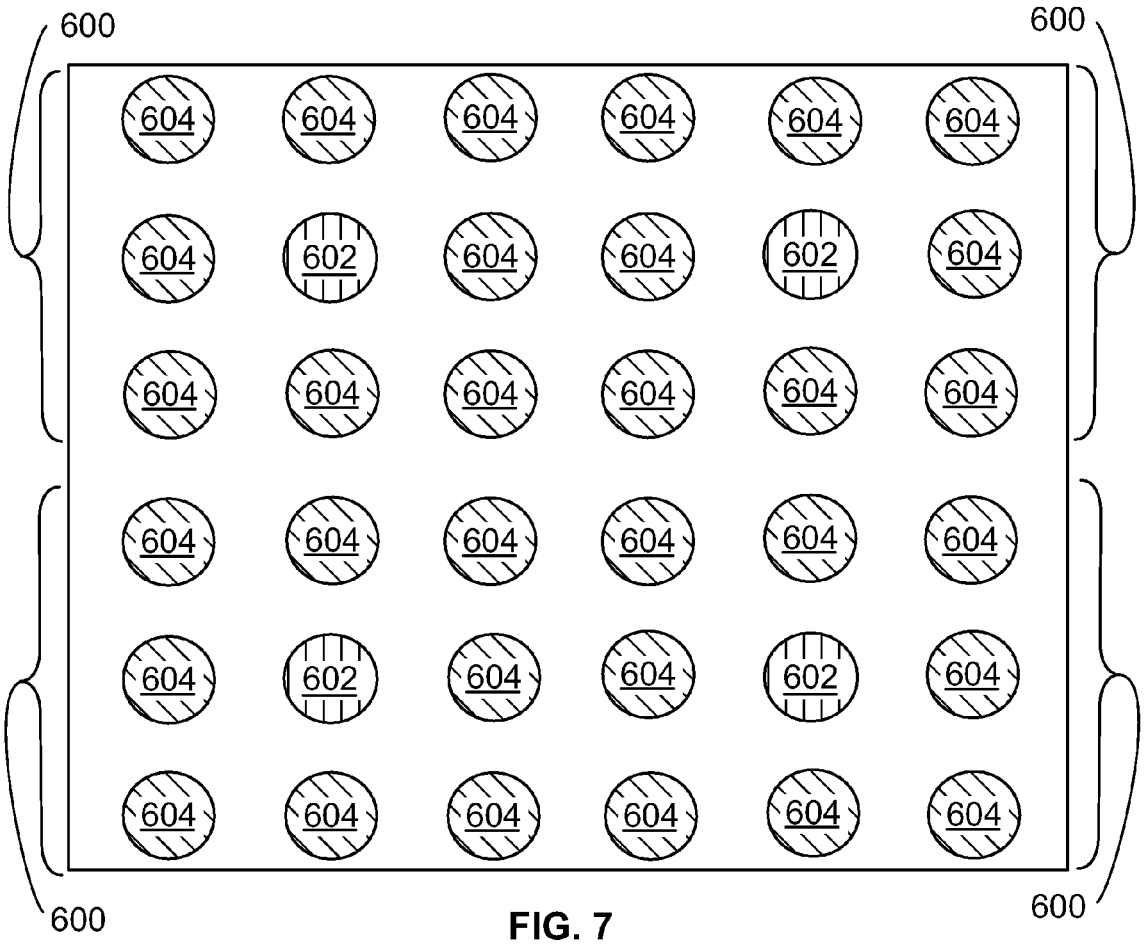
FIG. 7 is a schematic illustration of a plurality of the arrangements of the signal contacts shown in FIG. 6 according to an example embodiment.

FIG. 7 is a schematic illustration of a plurality of the arrangements 600 of the signal contacts 226 (shown in FIG. 2) according to an example embodiment. The ground locations 604 in each arrangement 600 are dedicated to the center location 602 in that arrangement 600. For example, the signal contacts 226 disposed in the dedicated ground locations 604 provide EMI shielding for the signal contact 226 located in the center location 602 of each arrangement 600. As shown in FIG. 7, the ground locations 604 in each arrangement 600 are not associated with or included in the ground locations 604 of any adjacent arrangement 600. For example, each ground location 604 is adjacent to only a single center location 602. As a result, the signal contacts 226 disposed in the ground locations 604 also are dedicated ground contacts for the signal contact 226 disposed in the center location 602 for each arrangement 600. As described above, while the discussion here focuses on the signal contacts 226, the cavities 506 may be disposed in the center and dedicated ground locations 602, 604 shown in FIG. 7.

Figure 8:
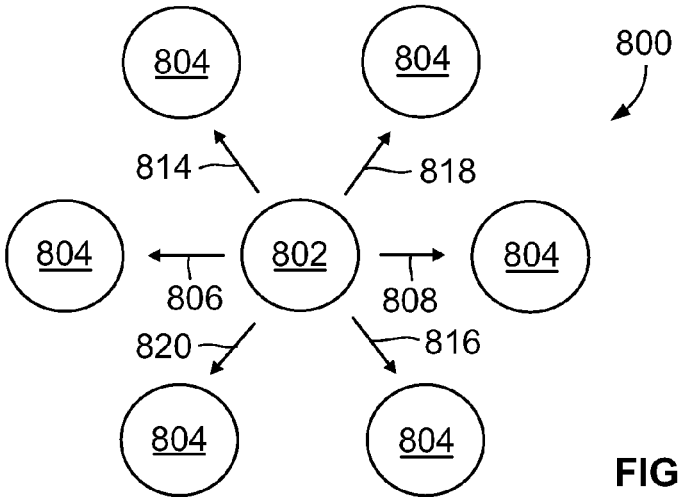
FIG. 8 is a schematic view of an example arrangement of the signal contacts shown in FIG. 2 in one or more of the groups shown in FIG. 2 according to an alternative embodiment.

FIG. 8 is a schematic view of an example arrangement 800 of the signal contacts 226 (shown in FIG. 2) in one or more of the groups 240, 242 (shown in FIG. 2) according to an alternative embodiment. The arrangement 800 illustrates the locations of signal contacts 226 in one or more of the groups 240, 242 in order for the group 240, 242 to emulate a coaxial connection. The arrangement 800 includes a center location 802 with a plurality of ground locations 804 disposed around the center location 802. In the illustrated embodiment, the ground locations 804 are arranged in a hexagonal shape around the center location 802. Alternatively, the ground locations 804 may be in a shape other than a hexagon. One signal contact 226 may be disposed at the center location 802 with a plurality of signal contacts 226 disposed at the ground locations 804 around the periphery of the center location 802.

The ground locations 804 may immediately surround the center location 802 such that all locations or contacts that are adjacent to the center location 802 are ground locations 804. For example, ground locations 804 may be disposed in the locations adjacent to the center location 802 in horizontal directions 806, 808 from the center location 802 and in diagonal directions 814-820 from the center location 802. The signal contacts 226 used to communicate a data signal may only have signal contacts 226 connected to an electrical ground disposed in all adjacent locations to the signal contact 226. No two signal contacts 226 are adjacent to one another in the arrangement 800 shown in FIG. 8.

In operation, the signal contact 226 in the center location 802 in the groups 240, 242 communicates a data signal. For example, the signal contact 226 in the center location 802 (referred to as the center signal contact 226) may communicate a signal in a manner similar to the center conductor in a coaxial cable connector. The signal contacts 226 disposed in the ground locations 804 are electrically connected to an electric ground. For example, the signal contacts 226 may be electrically connected to an electric ground of the motherboard 104 (shown in FIG. 1). The signal contacts 226 in the ground locations 804 may provide EMI shielding for the center signal contact 226. For example, the signal contacts 226 in the ground locations 804 may emulate the shield in a coaxial cable connector. While six ground locations 804 are shown in the illustrated embodiment, a different number of ground locations 804 may be used. Moreover, while the discussion herein focuses on the signal contacts 226 being disposed at the center location 802 and ground locations 804, the cavities 506 (shown in FIG. 5) in the mating connector 108 (shown in FIG. 1) may be arranged in a manner similar to the signal contacts 226. For example, the cavities 506 may be arranged in the arrangement 800 such that the cavities 506 may mate with the signal contacts 226.

As described above, the signal contacts 226 in the arrangement 800 may emulate a coaxial connector. The impedance of the coaxial connector that is emulated by the signal contacts 226 may be varied by changing the separation between the signal contacts 226 in the directions 806-820. For example, increasing the separation between the signal contacts 226 in the directions 806-820 may increase the impedance of the coaxial connector that is emulated by the signal contacts 226 in the arrangement 800. Alternatively, reducing the separation between the signal contacts 226 in the directions 806-820 may decrease the impedance of the coaxial connector that is emulated by the signal contacts 226 in the arrangement 800.

Figure 9:
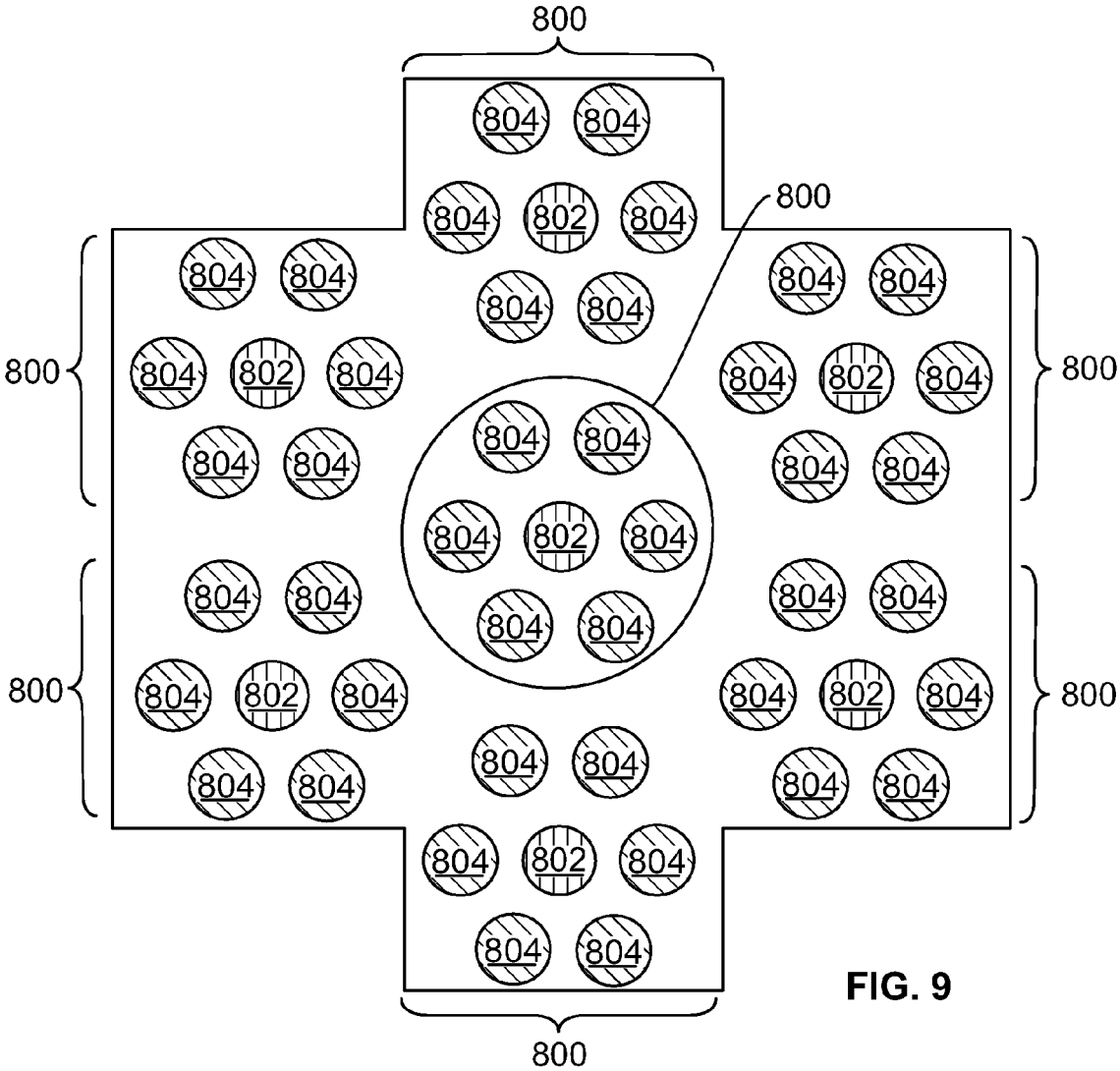
FIG. 9 is a schematic illustration of a plurality of the arrangements of the signal contacts shown in FIG. 8 according to an example embodiment.

FIG. 9 is a schematic illustration of a plurality of the arrangements 800 of the signal contacts 226 (shown in FIG. 2) according to an example embodiment. The ground locations 804 in each arrangement 800 are dedicated to the center location 802 in that arrangement 600. For example, the signal contacts 226 disposed in the dedicated ground locations 804 provide EMI shielding for the signal contact 226 located in the center location 802 in each arrangement 800. As shown in FIG. 9, the ground locations 804 in each arrangement 800 are not associated with or included in the ground locations 804 of any adjacent arrangement 800. For example, each ground location 804 is adjacent to only a single center location 802. As a result, the signal contacts 226 disposed in the ground locations 804 also are dedicated ground contacts for the signal contact 226 disposed in the center location 802 for each arrangement 800. As described above, while the discussion here focuses on the signal contacts 226, the cavities 506 may be disposed in the center and dedicated ground locations 802, 804 shown in FIG. 9.

It is to be understood that the above description is intended to be illustrative, and not restrictive. For example the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing for mating with a mating connector; and contacts in the housing for electrically connecting the connector assembly with the mating connector, the contacts arranged in a coaxial signal contact pattern and a differential signal contact pattern, the contacts in the coaxial signal contact pattern arranged in a plurality of groups with each group including a center signal contact surrounded by contacts electrically connected to an electric ground in a manner to emulate a coaxial connection with the mating connector, the contacts in the differential signal contact pattern comprising a plurality of adjacent signal contacts configured to communicate a differential pair signal with the mating connector, wherein the contacts of the coaxial signal contact pattern that are electrically connected to the electric ground are adjacent to only a single center signal contact.

2. The connector assembly of claim 1, wherein the contacts in the coaxial signal contact pattern and the differential signal contact pattern are substantially identical to one another.

3. The connector assembly of claim 1, wherein the center signal contact in the coaxial signal contact pattern is only a single signal contact.

4. The connector assembly of claim 1, wherein the contacts in the coaxial signal contact pattern are arranged such that the contacts adjacent to the center signal contact are electrically connected to the electric ground.

5. The connector assembly of claim 1, wherein the housing mechanically interconnects a plurality of circuit boards in a parallel arrangement and the contacts electrically interconnect the circuit boards.

6. The connector assembly of claim 1, wherein the contacts in the coaxial signal contact pattern are configured to communicate a radio frequency ("RF") signal between the connector assembly and the mating connector in a manner that emulates the coaxial connection.

7. The connector assembly of claim 1, wherein the coaxial signal contact pattern includes the contacts that are electrically connected to the electric ground being disposed in horizontal, transverse and diagonal directions from the center signal contact.

8. The connector assembly of claim 1, wherein the contacts comprise contact pins elongated between mating and mounting ends along a longitudinal axis, the mating ends configured to mate with the mating connector, the mounting ends configured to be loaded into a circuit board to electrically couple the circuit board with the mating connector.

9. The connector assembly of claim 1, wherein the contacts in the coaxial signal contact pattern include the contacts that are electrically connected to the electric ground being arranged in a hexagonal shape around the center signal contact.

10. A mezzanine connector assembly comprising:

a housing configured to interconnect circuit boards; and elongated contacts in the housing for electrically connecting the circuit boards, the contacts extending from a mating end to a mounting end along a longitudinal axis, the mating end configured to mate with a mating connector mounted to one of the circuit boards, the mounting end configured to be loaded into another one of the circuit boards, wherein first and second groups of the contacts are arranged in coaxial signal contact patterns to emulate coaxial connections having different impedance characteristics between the circuit boards, the first and second groups of the contacts in the coaxial signal contact patterns including a center signal contact surrounded by ground contacts that are electrically coupled with an electric ground, wherein the center signal contacts in the first and second groups of the contacts in the coaxial signal contact patterns are separated from one another by a plurality of the ground contacts and the center signal contact in the first group is separated from the ground contacts of the first group by a different distance than a distance between the center signal contact and the ground contacts in the second group.

11. The mezzanine connector assembly of claim 10, wherein the center signal contact in at least one of the first or second groups is surrounded by the ground contacts in each of opposite diagonal directions, opposite horizontal directions and opposite transverse directions.

12. The mezzanine connector assembly of claim 10, wherein the center signal contact in each of the coaxial signal contact patterns of at least one of the first or second groups is only a single signal contact.

13. The mezzanine connector assembly of claim 10, wherein the contacts in the coaxial signal contact pattern of at least one of the first or second groups are arranged such that the ground contacts in the at least one of the first or second groups includes the contacts that are adjacent to the center signal contact.

14. The mezzanine connector assembly of claim 10, wherein each of the ground contacts in at least one of the first or second groups of contacts is adjacent to only a single center signal contact.

15. The mezzanine connector assembly of claim 10, wherein a third group of the contacts is arranged in a differential pair signal contact pattern, the contacts in the differential pair signal contact pattern comprising a plurality of adjacent signal contacts configured to communicate a differential signal between the circuit boards.

16. The mezzanine connector assembly of claim 10, wherein the contacts are elongated pins.

17. The connector assembly of claim 1, wherein the contacts are elongated pins that linearly extend between opposite ends.

18. The mezzanine connector assembly of claim 10, wherein the contacts linearly extend between opposite ends.

19. The mezzanine connector assembly of claim 10, wherein the contacts comprise contact pins that are linearly elongated between opposite mating and mounting ends along a longitudinal axis, the mating ends configured to loaded into the mating connector, the mounting ends configured to be loaded into one of the circuit boards.

20. The mezzanine connector assembly of claim 10, wherein the ground contacts in the coaxial signal contact patterns of at least one of the first or second groups are arranged in a hexagonal shape around the center signal contact.

* * * * *